US010612216B2

(12) United States Patent
Kennedy

(10) Patent No.: US 10,612,216 B2
(45) Date of Patent: Apr. 7, 2020

(54) APPARATUS AND METHOD TO MOUNT SENSORS BELOW A MAIN VALVE OF A FIRE HYDRANT

(71) Applicant: Kennedy Valve Company, Elmira, NY (US)

(72) Inventor: Paul Kennedy, Horseheads, NY (US)

(73) Assignee: Kennedy Valve Company, Elmira, NY (US)

( * ) Notice: Subject to any disclaimer, the term of this patent is extended or adjusted under 35 U.S.C. 154(b) by 76 days.

(21) Appl. No.: 16/123,583

(22) Filed: Sep. 6, 2018

(65) Prior Publication Data

US 2020/0080290 A1 Mar. 12, 2020

(51) Int. Cl.

| | |
|---|---|
| ***E03B 7/07*** | (2006.01) |
| ***E03B 9/02*** | (2006.01) |
| ***E03B 7/09*** | (2006.01) |
| ***E03B 7/02*** | (2006.01) |

(52) U.S. Cl.

CPC ..... *E03B 7/07* (2013.01); *E03B 7/02* (2013.01); *E03B 7/095* (2013.01); *E03B 9/02* (2013.01); *E03B 2009/022* (2013.01)

(58) Field of Classification Search

CPC ..... E03B 7/07; E03B 9/02; E03B 9/08; E03B 9/10; E03B 9/12; F16K 37/005

See application file for complete search history.

(56) References Cited

U.S. PATENT DOCUMENTS

| | | | | |
|---|---|---|---|---|
| 6,058,957 | A * | 5/2000 | Honigsbaum | E03B 9/02 137/1 |
| 6,816,072 | B2 * | 11/2004 | Zoratti | A62C 31/28 137/272 |
| 8,589,092 | B2 * | 11/2013 | Plouffe | E03F 7/00 702/50 |
| 9,194,108 | B2 * | 11/2015 | Fleury, Jr. | E03B 9/02 |
| 9,260,840 | B2 * | 2/2016 | Kennedy | E03B 9/08 |
| 9,260,841 | B2 * | 2/2016 | Kennedy | E03B 9/08 |
| 9,458,609 | B2 * | 10/2016 | Fleury, Jr. | E03B 9/02 |
| 2017/0082592 | A1 | 3/2017 | Morrow | |

OTHER PUBLICATIONS

TELOG, Automated Wireless Monitoring of Water Distribution Systems, Mar. 2014.

* cited by examiner

*Primary Examiner* — Kevin F Murphy

(74) *Attorney, Agent, or Firm* — Brown & Michaels, PC

(57) ABSTRACT

A main valve assembly and a method of forming the same which can contain sensors therein that are in contact with water below the main valve and provide water characteristic signals above ground to a water characteristic monitoring device at atmospheric pressure.

20 Claims, 5 Drawing Sheets

APPARATUS AND METHOD TO MOUNT SENSORS BELOW A MAIN VALVE OF A FIRE HYDRANT

BACKGROUND OF THE INVENTION

Field of the Invention

The invention pertains to the field of fire hydrants. More particularly, the invention pertains to an apparatus and method to mount sensors below a main valve of a fire hydrant.

Description of Related Art

FIG. 1 illustrates a fire hydrant's lower standpipe 16 that houses a motion detector 214 connected to a valve plate 230, as disclosed in U.S. Pat. No. 6,816,072 by Zoratti. In Zoratti the lower standpipe 16 of a fire hydrant is connected to a shoe assembly 232, which receives water flow from a water main. The shoe assembly 232 is generally underground, and is connected to a water main supply pipe (not illustrated) also underground to supply water to the fire hydrant via the shoe assembly 232. A connector assembly 216 and 218 connects the motion detector 214 to a control means (not illustrated) in a housing 150 (illustrated in other figures) disposed at the top portion of the fire hydrant. The motion detector 214 generates a signal indicating the position of the valve plate 230. This signal is transmitted to the control means in the housing 150 via a cable 220. The control means then transmits a signal to a remote location identifying the particular fire hydrant in which the lower valve 230 has moved.

Also described in U.S. Pat. No. 6,816,072 is a pressure transducer 240 disposed above the valve plate 230. The pressure transducer 240 sits on top of another connector assembly 216 and 218, which is connected to a bore extending through the valve plate 230, where the pressure transducer 240 can read the water pressure in the supply main through the connector assembly 216 and 218.

SUMMARY OF THE INVENTION

The forgoing and/or other features and utilities of the present inventive concept can be achieved by providing a main valve assembly usable with a fire hydrant, the main valve assembly comprising: a circular main valve plate having a beveled outer edge circumferentially around one side thereof and including: a first hole extending through a center thereof, and a second hole extending therethrough between the outer edge thereof and the first hole; a circular drain valve including: a first hole extending through a center thereof, a second hole extending therethrough between an outer periphery thereof and the first hole, and a groove formed circumferentially in one side thereof facing the main valve plate, the groove having a same center axis as the periphery and extending between the periphery and the second hole such that an O-ring disposed within the groove forms a waterproof seal with the main valve plate; a circular bottom plate having a diameter equal to a diameter of the main valve plate and being disposed at a side of the main valve plate opposite to the side facing the drain valve, the bottom plate including: a chamber formed into one side thereof facing the main valve plate; a first hole extending through a center thereof and the chamber, and at least one port hole extending through the bottom plate within the chamber and having threads formed therein to receive a respective threaded water characteristics sensor therein, the threads of the at least one port hole forming a water-tight seal with the water characteristics sensor; and a lock nut having a hole extending partially therein at a center thereof and a groove formed circumferentially around the hole to receive an O-ring that forms a water-tight seal with a side of the circular bottom plate opposite the side facing the main valve plate.

According to an exemplary embodiment, the main valve assembly can further comprise a compressing fitting threaded into the second hole of the main valve and having a tube extending from an inner portion thereof away from the main valve plate, the tube including wires extending therethrough and through the second hole in the main valve plate and into the chamber of the bottom plate.

According to another exemplary embodiment the first hole of the drain valve includes at least one groove formed therein to receive a respective O-ring which forms a water-tight seal with a stem of a fire hydrant.

According to another exemplary embodiment the first hole of the main valve plate and the first hole of the bottom plate are formed to receive the stem of a fire hydrant therethrough such that the lock nut threads over a threaded end of the stem to seal the drain valve to the main valve with an O-ring in the groove of the drain valve, and to seal the main valve to the bottom plate with an O-ring in the groove of the bottom plate, and to seal the lock nut to the bottom plate with an O-ring in the groove of the lock nut.

According to another exemplary embodiment the drain valve is disposed within a valve seat of a fire hydrant such that when the stem is being raised with the fire hydrant the main valve plate also rises such that the beveled outer edge of main valve plate contacts the seat formed about one circular end of the valve seat to form a water-tight seal with seat.

According to another exemplary embodiment, the main valve assembly can further comprise a pressure sensor threaded into one port hole and a temperature sensor threaded into another port hole.

According to another exemplary embodiment the drain valve and main valve plate are formed of a metal surrounded by a rubber coating, the rubber coating being flexible to cause a water-tight seal with the stem, the sealing ring and the compression fitting.

The forgoing and/or other features and utilities of the present inventive concept can also be achieved by providing a main valve assembly of a fire hydrant, the main valve assembly comprising: a main valve including a drain valve and a main valve plate, one of the drain valve and the main valve plate having a circular groove formed in a side thereof facing the other one of the drain valve and the main valve plate, the groove retaining an O-ring therein to form a water-tight seal therebetween, the drain valve and main valve plate each including a first hole extending through a center thereof within the circumference of the groove and in axial alignment with each other to each receive a stem of a fire hydrant therethrough and a second hole extending therethrough between the groove and the respective first holes, the second hole of the drain valve being threaded to receive a compression fitting therein; and a bottom plate adjacent to a side of the main valve plate opposite to the side that forms a seal with the drain valve, the bottom plate including: a trench formed into the side facing the main valve plate; a groove formed around the trench to receive an O-ring therein that forms a water-tight chamber between the trench and the main valve plate; a hole extending through a center thereof to receive the stem therethrough, and at least one water characteristics sensor extending through a bottom surface of the trench and out of a side of the bottom plate opposite the side facing the main valve plate.

According to an exemplary embodiment the main valve assembly can further comprise a lock nut having threads formed therein to engage with threads formed at the end of the stem and a groove formed circumferentially around the threads to receive an O-ring therein to form a water-tight seal with the bottom plate at a side opposite the side adjacent to the main valve plate.

According to another exemplary embodiment the circular groove formed in one of the drain valve and the main valve plate is formed in the drain valve.

According to another exemplary embodiment the drain valve and main valve plate are formed of a metal coated with a rubber.

According to another exemplary embodiment the first hole in the drain valve includes at least one groove formed therein to receive a respective O-ring that forms a water-tight seal between the drain valve and the stem.

According to another exemplary embodiment the main valve assembly can further comprise a brass compressing fitting including a tube extending from one side thereof to receive wires through the compression fitting and the tube, the compression fitting being threaded into the second hole of the drain valve such that the tube provides atmospheric pressure to the water-tight chamber.

According to another exemplary embodiment the first hole in the drain valve includes at least one groove formed therein, each groove including an O-ring therein to form a tight seal between the first hole and the stem that extends therethrough.

The forgoing and/or other features and utilities of the present inventive concept can also be achieved by providing a method of mounting sensors in a water-proof area below a main valve of a fire hydrant, the method comprising: providing a first circumferential sealing means along an area adjacent to outer perimeters of a drain valve and a main valve plate of a main valve, the drain valve and the main valve plate each including a center hole formed therethrough and in axial alignment to receive a hydrant stem therethrough; forming a threaded hole through the drain valve within the circumference of the first sealing means; threading a compression fitting through the threaded hole in the drain valve, the compression fitting having a tube extending out of one end facing away from the main valve plate to provide outside pressure to an area within the circumferential sealing means between the drain valve and the main valve plate; forming a second hole through the main valve plate within the circumference of the first sealing means; providing a second circumferential sealing means along an area adjacent to outer perimeters of a bottom plate and a side of the main valve plate not facing the drain valve, the bottom plate including a trench formed therein within the circumference of the second sealing means, a center hole in axial alignment with the center holes of the drain valve and the main valve plate and extending through the trench to receive the hydrant stem therethrough, and at least one port hole extending through the surface of the trench to receive a respective sensor therein; threading a water characteristics sensor into the at least one port hole such that the sensor end extends outside the bottom plate, the sensor including wires extending from ends opposite the sensor end; feeding the wires extending from the at least one sensor through the second hole in the main valve plate and through the tube extending from the compression fitting; extending the fire hydrant stem through the center holes of the drain valve, main valve plate and the bottom plate; threading a lock nut onto the end of the stem extending through the bottom plate; and forming a third circumferential seal between the surface of the bottom plate and the lock nut to surround the stem.

According to an exemplary embodiment the method may further comprise forming at least one groove circumferentially within the center hole of the drain valve; and inserting a O-ring within the at least one groove to form a tight seal between the center hole of the drain valve and the stem.

According to another exemplary embodiment the method may further comprise fitting the main valve into a valve seat threaded into a fire hydrant shoe connected to a fire hydrant with the stem extending therethrough such that when the stem is moved upward and downward, a perimeter of the main valve plate forms a water-tight seal with an end of the valve seat extending into the shoe.

DETAILED DESCRIPTION OF THE INVENTION

Figure 1:
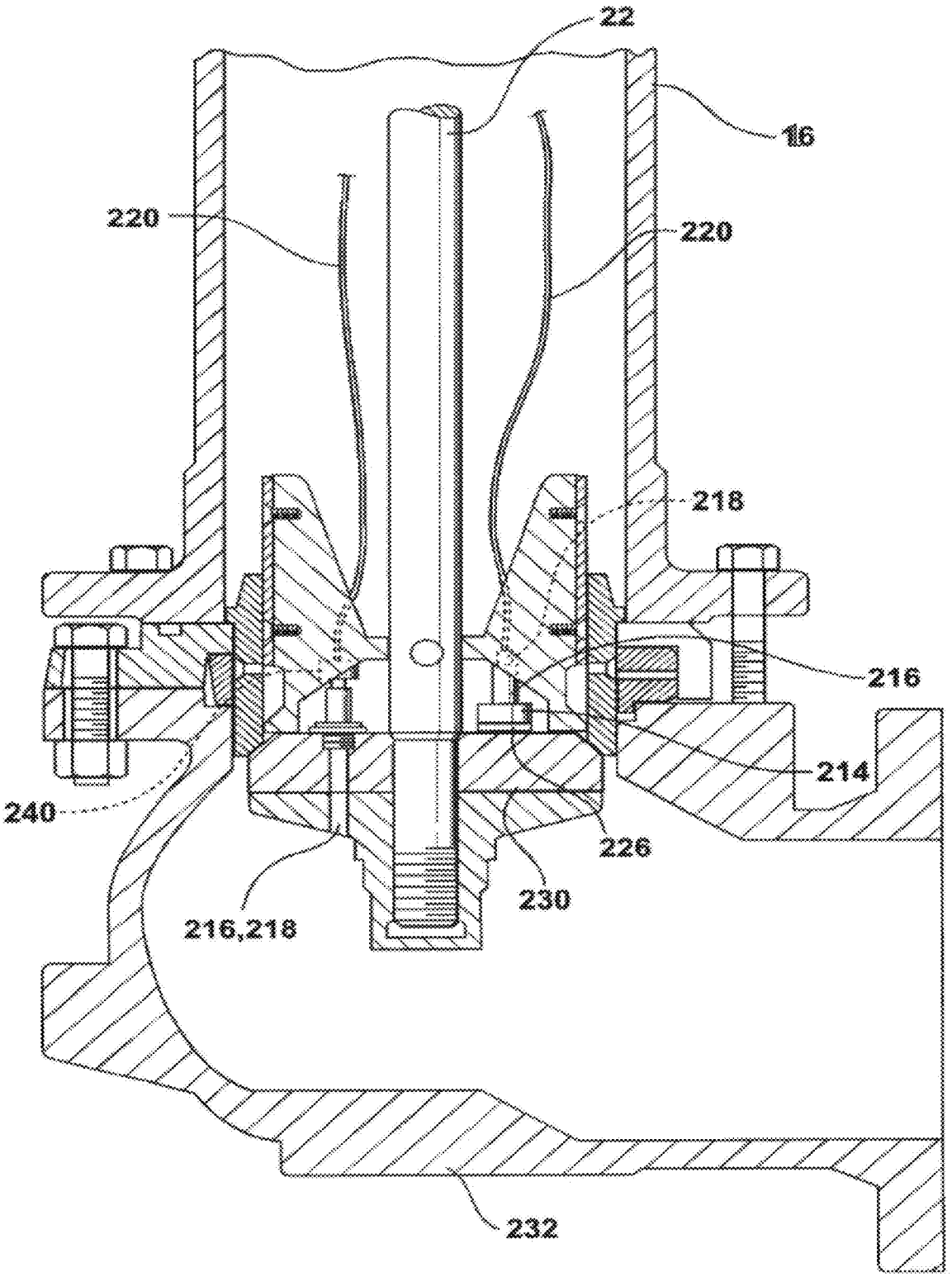
FIG. 1 (PRIOR ART)
FIG. 1 illustrates a lower standpipe of a fire hydrant having sensors disposed above a main valve plate, according to a conventional fire hydrant.

In the following description, reference is made to the accompanying drawings that form a part thereof, and in which is shown by way of illustration specific example embodiments in which the present teachings may be practiced. These embodiments are described in sufficient detail to enable those skilled in the art to practice the present teachings and it is to be understood that other embodiments may be utilized and that changes may be made without departing from the scope of the present teachings.

The terminology used herein is for the purpose of describing particular example embodiments only and is not intended to be limiting. As used herein, the singular forms "a", "an", and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Spatially relative terms, such as "inner," "outer," "beneath", "below", "lower", "above", "upper" and the like, may be used herein for ease of description to describe one element or feature's relationship to another element(s) or feature(s) as illustrated in the Figures Spatially relative terms may be intended to encompass different orientations of the device in use or operation in addition to the orientation depicted in the Figures. For example, if the device in the Figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Figure 2A:
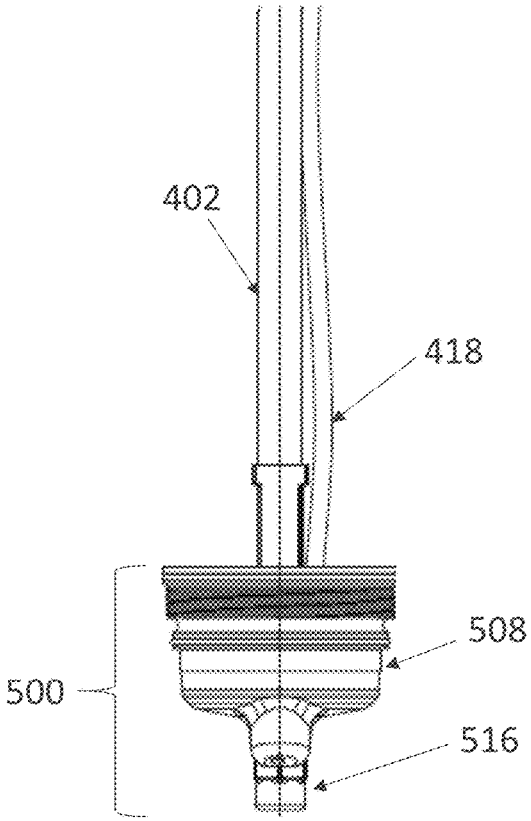
FIG. 2A illustrates a side view of a fire hydrant's stem and main valve assembly, according to an exemplary embodiment of the present inventive concept.

FIG. 2A illustrates a lower stem 402 of a fire hydrant connected to a main valve assembly 500, according to an exemplary embodiment of the present inventive concept. The main valve assembly 500 according to this exemplary embodiment includes a bottom plate 508 that is configured to receive at least one sensor therein (see, e.g., FIG. 2C, sensors 512, 514) to measure characteristics of water, for example temperature, pressure, and/or other water related characteristics within an underground water main and within a shoe (or elbow) (see FIG. 4A) to which a fire hydrant connects in order to receive water flow. The bottom plate 508 can be fixedly attached to the lower stem 402 of a fire hydrant by a lock nut 516. A tube 418 having wires extending therethrough can be connected to the at least one sensor disposed within the bottom plate 508. The tube can be formed from Polyethylene, or another material that will perform the intended functions as described herein. The wires within the tube 418 can carry signals generated at the sensor(s) to wireless communications electronics (not illustrated) devices, that can be disposed above ground and either in an upper barrel or bonnet of the fire hydrant, or in a separate electronics storage connected to the upper barrel or bonnet of the fire hydrant. The bottom plate 508 can have a sensor port formed therein in which each sensor can be positioned, as described in more detail below, to measure different water characteristics below a main valve of the fire hydrant.

Figure 2B:
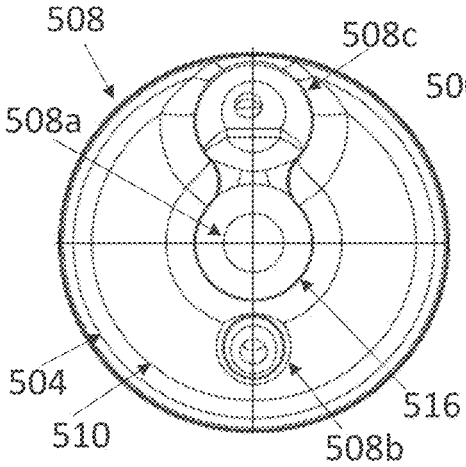
FIG. 2B illustrates a bottom view of a bottom plate of the main valve assembly of FIG. 2A.

FIG. 2B illustrates a bottom view of the bottom plate 508. As illustrated in FIG. 2B, the bottom plate 508 can include a bottom plate trench 510 formed to a predetermined depth and width within a center f the bottom plate 508. The trench 510 can be circular in shape. Extending from a surface (bottom of trench as a hydrant is standing upright) of the bottom plate trench 510 are illustrated two sensor port holes 508*b* and 508*c* that are formed through the bottom plate 508 within the trench 510 and can include threads to receive threaded sensors therein. However, the port holes 508*b* and 508*c* can have another type of seal surface therein to form a water-tight seal with the respective sensor inserted therein. For example, the port holes 508*b* and 508*c* can include grooves therein that receive O-rings, which can form a water-tight seal with the inserted sensor. The port holes 508*b* and 508*c* can alternatively be integrally formed with a respective sensor therein, which would not require any additional parts to form a water-tight seal.

These sensor port holes 508*b* and 508*c* can receive a respective sensor that can detect various water characteristics below the bottom plate 508. In an exemplary embodiment, the sensor port holes 508*b* and 508*c* can have threads formed therein to be threaded with the threads formed around the outer circumference of the respective sensor.

The bottom plate trench 510 is configured to be sufficient in size to retain part of the sensors (i.e., back portion) therein that is not threaded into the respective port hole, and also wiring attached to the back of the sensors. The sensing ends (i.e., front portion) of the sensors extend through sensor port holes 508*b* and 508*c* to be directly in contact with the water below the bottom plate 508 so that the sensors can accurately detect the characteristics of the water that flows below the bottom plate 508.

Figure 2C:
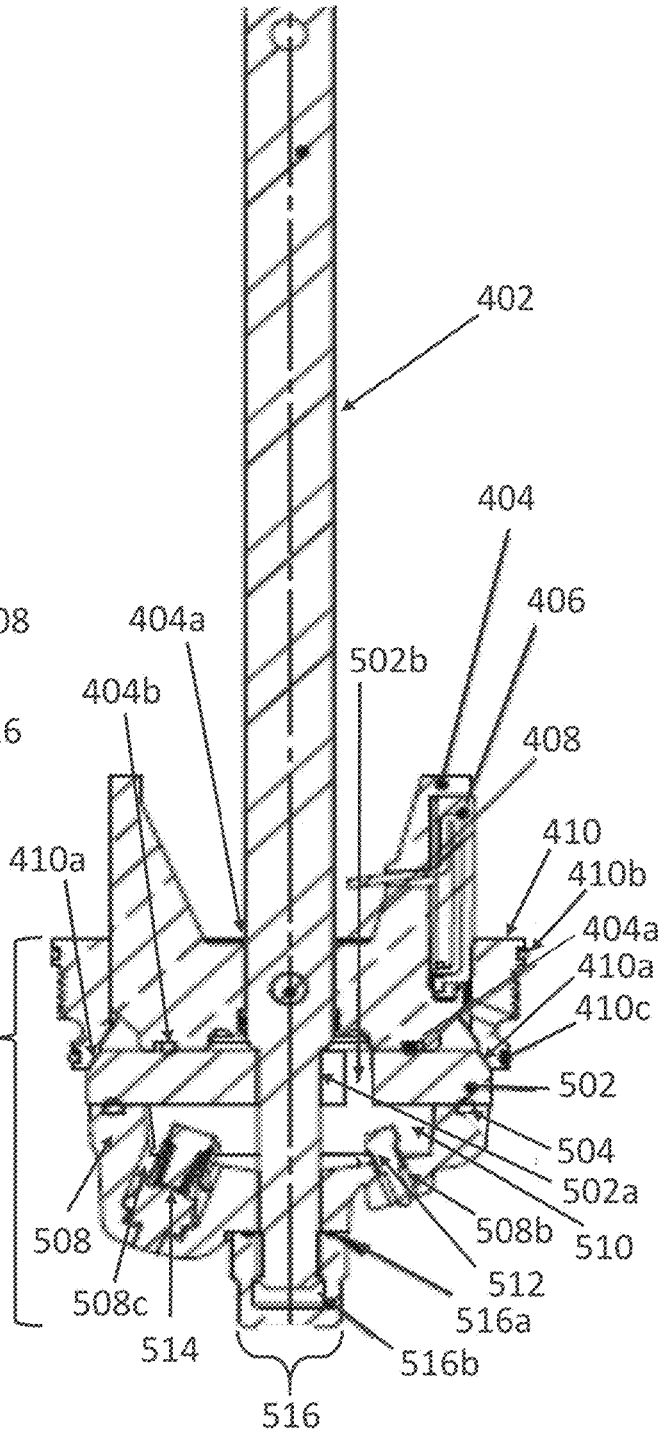
FIG. 2C illustrates a detailed perspective view of the main valve assembly according to the exemplary embodiment illustrated in FIG. 2A.

FIG. 2C illustrates a detailed perspective view of internal components of the main valve assembly 500, according to the exemplary embodiment illustrated in FIG. 2A and FIG. 2B. In FIG. 2C the sensor port holes 508*b* and 508*c* can retain a pressure sensor 512 and a temperature sensor 514 therein, respectively. However, these sensor ports 508*b* and 508*c* can be configured to have different size diameters and lengths to receive and retain any type of sensor desired to sense different water characteristics of water below the bottom plate 508.

A main valve used with a fire hydrant is generally know to include a drain valve 404, which can be secured within a valve seat 410, which in turn is threaded into a valve seat 411 threaded into an elbow (see FIG. 4A). while the valve seat 410 can be threaded to a threaded opening 452 (see FIG. 4A) in a shoe (or elbow) 450. The drain valve 404 generally receives the lower stem 402 of the hydrant through a hole 404*a* extending through a center thereof to allow the lower stem 402 to connect to and control operations of closing and opening of a main valve plate 502 with respect to a seat 410*a* of the valve seat 410. The seat 410*a* is formed around a periphery of an inner surface of one end of the valve seat 410. The lower stem 402 also extends through, and is press fitted within a hole 502*a* extending through the center of the main valve plate 502.

The main valve plate 502 can be moved toward and away from the valve seat 410, and hence the seat 410*a*. The main valve plate 502 can be moved toward and away from the seat 410*a* of the valve seat 410 by rotating a stem lock nut (not illustrated), which is generally threaded to one end of an upper stem (not illustrated) while the other end of the upper stem is connected to the lower stem 402. Therefore, when the stem lock nut is rotated in the clockwise and counter-clockwise directions, the lower stem 402 moves up and down, which moves the main valve plate 502 toward and away from the seat 410*a* of the valve seat 410 to control the flow of water into the lower barrel of the fire hydrant. In other words, the operations of sealing the main valve plate 502 against the seat 410*a* of the valve seat 410 and moving the main valve plate 502 away from the seat 410*a* of the valve seat 410 acts as a flow control for water through the fire hydrant. The lower stem 402 generally moves up and down when a special type of wrench is used to turn the stem lock nut.

The drain valve 404 and main valve plate 502 can each be formed of a metal surrounded by a rubber material that has the proper flexibility to help form a water-tight seal with surfaces the drain valve 404 and the main valve plate 502 respectively contact, such as the lower stem 402 and the seat 410*a*.

Still referring to FIG. 2C, the drain valve 404 can include a groove 404*b* circumferentially formed around and outside the hole 404*a*. The groove 404*b* can receive an O-ring therein to provide a water-tight seal with the main valve plate 502. The bottom plate 508 can also include a groove 504 formed between an outer periphery of the bottom plate 508 and an outer periphery of the bottom plate trench 510. The groove 504 can receive an O-ring therein to form a water-tight seal between the bottom plate 508 and the main valve plate 502. The bottom plate 508 can include a hole 508*a* extending through a center thereof. The lower stem 402 can extend through the hole 404*a* in the drain valve 404, through the hole 502*a* in the center of the main valve plate 502 and through the hole 508*a* extending through the center of the bottom plate 508. Since each of the holes 404*a*, 502*a* and 508*a* form a water-tight seal with the stem 402, no water can enter areas between the drain valve 404 and the bottom plate 508. The lock nut 516 can include a groove 516*a* formed circumferentially around a threaded hole 516*b* formed therein. The groove 516*a* can receive an O-ring therein such that when the lock nut 516 is threaded to the bottom end of the lower stem 402, the O-ring in the groove 516*a* forms a tight seal with the bottom plate 508. Alternatively, other forms of sealing the hole 508*a* of the bottom plate 508 can be used in place of the lock nut 516, such as, for example providing grooves within the hole 508*a* that can receive O-rings therein which will provide a water-tight seal with the lower stem 402.

The bottom plate trench 510 is configured to be of a depth and width sufficient to contain a portion of the sensor(s) therein as well as wiring attached to the sensor(s). As described above, extending through the bottom plate 508 within an area of the bottom plate trench 510 can be the sensor port holes 508*b* and 508*c* that can receive therein the pressure sensor 512 and the temperature sensor 514, respectively. However, other types of sensors can be disposed within the sensor port holes 508*b* and 508*c*, as desired, and more than two sensor port holes can be provided through the bottom plate 508 to contain more than two sensors to detect additional characteristics of water. Further, sensors can be welded to the bottom plate 508 such that back portions thereof extend into the bottom plate trench 510 and front sensing portions can extend below the bottom plate 508 to make contact with water below the bottom plate 508.

Also illustrated in FIG. 2C is another hole 502*b* that extends through the main valve plate 502. This hole 502*b* provides for wires to be able to extend therethrough to connect with the sensors 512 and 514, or other sensors as, desired, at one end and connect with electronics in the upper part of the fire hydrant or outside of the fire hydrant at the other end. The wires can also be connected at the other end to other types of electronics provided above ground, which are intended to receive signals generated by the sensors 512 and 514. These signals received from the sensors can convey information regarding the water characteristics being detected by the sensors. Various electronics can be connected to the sensors via the wires extending through the main valve plate 502 and the drain valve 404 such as, for example wireless communications electronic devices that can transmit the received signals to remote locations that can monitor the detected characteristics of the water flowing in the water main and in the shoe 450. While a tube 418 terminates within a compression fitting 420 that can be threaded through the drain valve 404 (described in detail below), wires can continue past the tube 418 and compression fitting 420 and through the hole 502*b* in the main valve plate 502 to connect to the sensors, which is described in further detail below.

Figure 3:
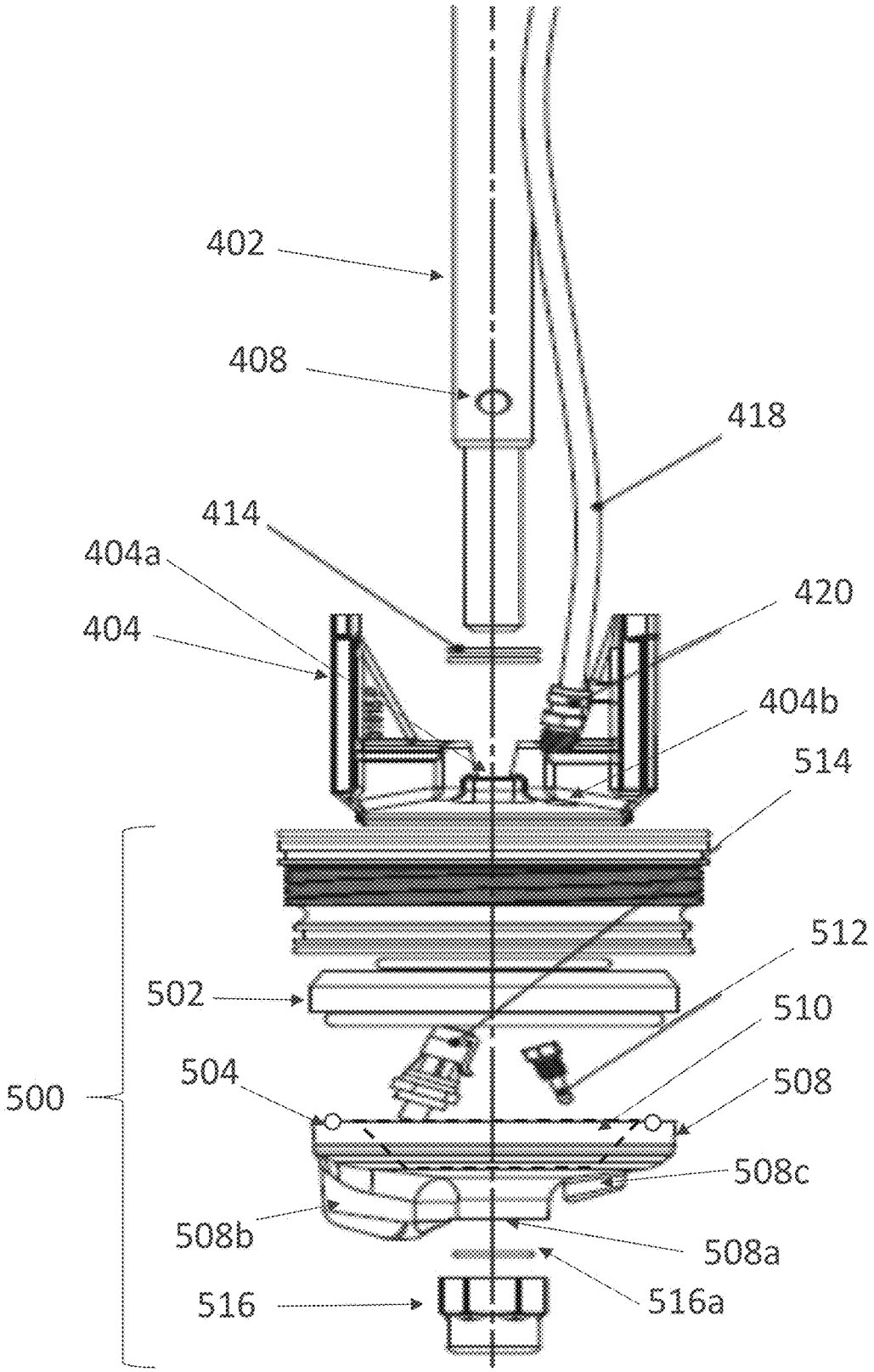
FIG. 3 illustrates an expanded pre-assembled perspective view of the stem and main valve assembly according to the exemplary embodiment illustrated in FIGS. 2A and 2C.

FIG. 3 illustrates an exploded perspective view of the main valve assembly 500 of FIGS. 2A and 2C. As illustrated in FIG. 3, a compression fitting 420 can be threaded through the hole 404*b* in the drain valve 404. The tube 418 can terminate at the externally exposed end of the compression fitting 420. The end of the tube 418 can be securely connected within the compression fitting 420 so there are no leaks at the connection. The tube 418 extends from the compressing fitting 420 to a location above ground to allow pressure in the bottom plate chamber 510 to remain at atmosphere. The wires 418*a* (see FIGS. 4A and 4B), without the tubing 418, can continue from the compression fitting 420 through the hole 502*b* in the main valve plate 502 and into the bottom plate trench 510 where the wires 418*a* connect to the sensors. It is to be noted that after the main valve plate 502 is sealed against the bottom plate 508 with an O-ring in groove 504, which forms the seal therebetween, the bottom plate trench 510 becomes a sealed chamber 510. More specifically, the main valve plate 502 becomes a fourth wall for the chamber 510, and will therefore be referred to as the bottom plate chamber 510 in the figures illustrating the bottom plate 508 being in contact with and sealed to the main valve plate 502.

The pressure sensor 512 (or other type of sensor) having a predetermined size can be securely threaded into the sensor port 508*b* (or other type of sensor) and the temperature sensor 514, having a larger size, can be securely threaded into the sensor port 508*c*. Back portions of the sensors 512 and 514, where the wires 418*a* are connected, as well as the wiring 418*a* itself, can be contained within the bottom plate chamber 510. As described above, an O-ring can be disposed in the groove 504 formed around the outer periphery of the bottom plate chamber 510 and within the outer periphery of the bottom plate 508 itself. The O-ring within groove 504 therefore forms a water-tight seal between the main valve plate 502 and the bottom plate 508.

Referring to FIG. 2C and FIG. 3, at least one O-ring 414, which can be seated within a respective groove (not illustrated) within the hole 404*a*, forms a seal between the hole 404*a* and the lower stem 402. The main valve assembly 500 can be operated by inserting the lower stem 402 through the at least one O-ring 414 seated in a respective groove in the hole 404*a*, inserting the lower stem 402 through the hole 502*a* formed through the main valve plate 502, and inserting the lower stem 402 through a hole 508*a* formed through the center of the bottom plate 508. As the threaded end of the lower stem 402 extends through the hole 508*a* in center of the bottom plate 508, the lock nut 516 can be threaded onto the threaded end of the lower stem 402. The main valve assembly 500 can then be operated by moving the stem 402 up and down such that the tightly fitted main valve plate 502 moves up and down also, and therefore the main valve plate 502 can be moved toward and away from the seat 410*a* formed around the periphery of the valve seat 410, as illustrated in FIG. 2C, to control the flow of water through the fire hydrant.

Figure 4A:
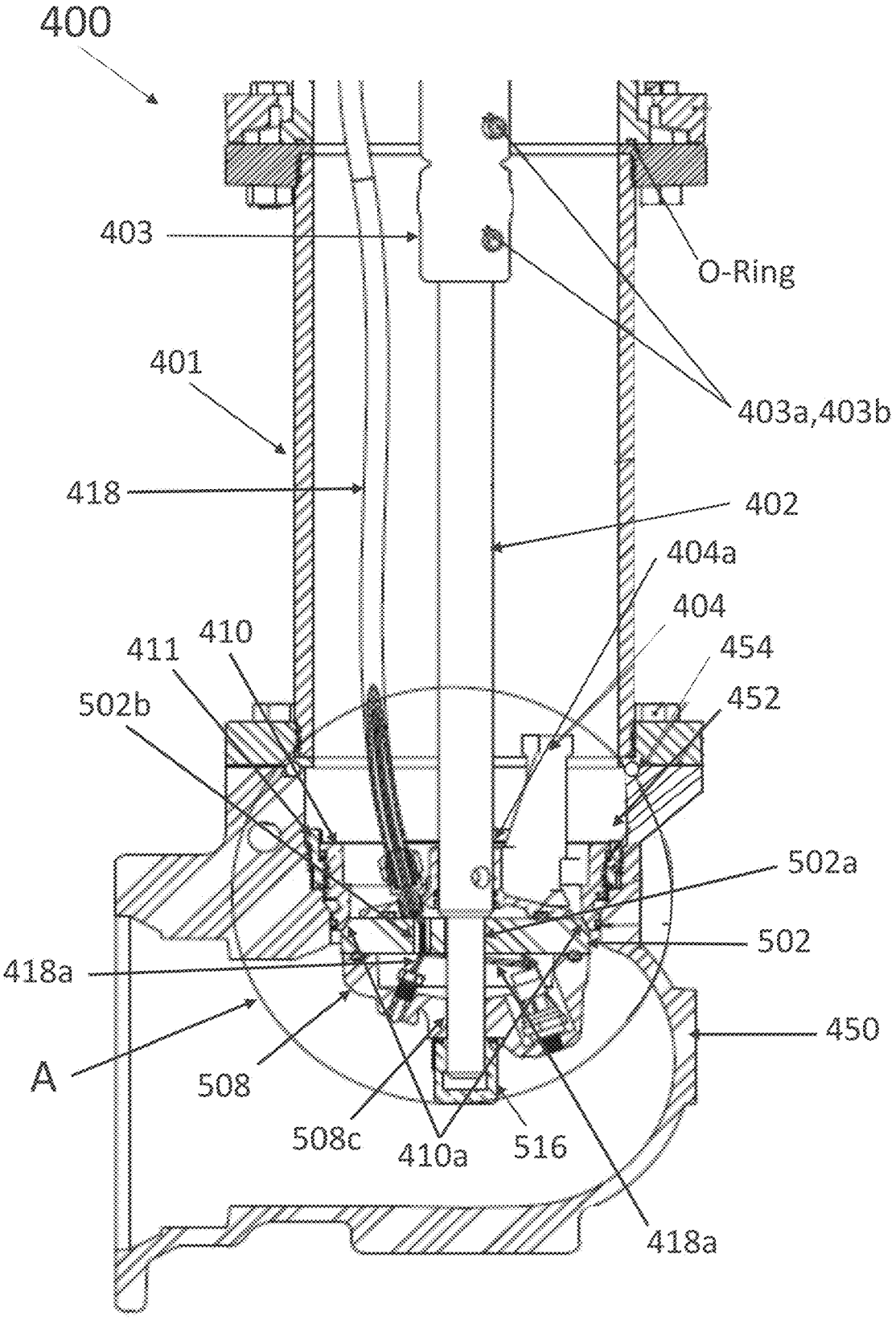
FIG. 4A illustrates an expanded perspective view of the main valve assembly according to the exemplary embodiment of FIGS. 2A through 4A, as connected to a shoe and a lower barrel with stem.
Figure 4B:
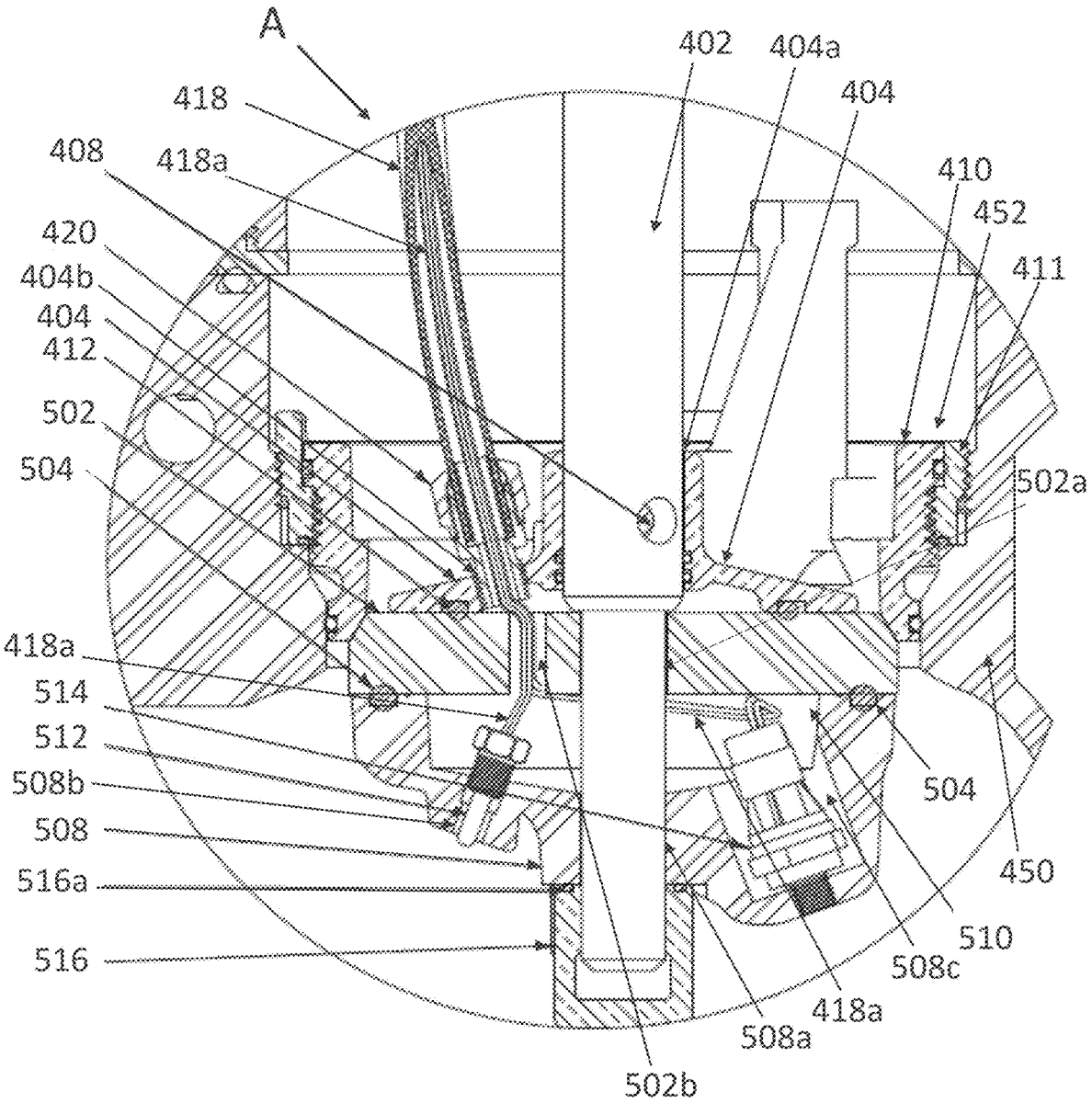
FIG. 4B illustrates an expanded detailed view of the lower barrel with stem and main valve assembly of FIG. 4A.

FIG. 4A illustrates a perspective view of a lower barrel 401 of a fire hydrant with the stem 402 inserted axially therethrough and connected to the main valve assembly 500. FIG. 4A further illustrates the main valve assembly 500 positioned in operational connection with the stem 402, the lower barrel 401 and a shoe 450. As shown, the stem 402 extends axially through the center of the lower barrel 401, through the drain valve hole 404*a*, through the main valve plate hole 502*a* and through the bottom plate hole 508*a*. Circled section "A" emphasizes the main valve assembly 500, according to the exemplary embodiment of FIGS. 2A through 3, and the assembly's 500 connection to a lower barrel 401 of a fire hydrant and elbow 450. FIG. 4B illustrates an expended view of the main valve assembly 500 in section A, which is described below in detail.

FIG. 4B illustrates the valve seat 410 fully threaded into a seal ring 411, which is threaded into the opening 452 of the shoe 450. The drain valve 404 is secured within the valve seat 410. The lower stem 402 extends through the hole 404*a* in the drain valve 404 and through the hole 502*a* in the main valve plate 502. The lower stem 402 also extends through the bottom plate chamber 510 and through the hole 508*a* in the bottom plate 508. The end of the lower stem 402 is also illustrated to be fixed to the end of the lock nut 516. It is to be noted that the end of the lower stem 406 can be threaded as well as the inside of the lock nut 516, such that the lock nut 516 can be securely threaded to the end of the lower stem 402. Alternatively, the lock nut 516 can be secured to the end of the lower stem 402 by any other means that will provide a secure connection to the lower stem 402 while also providing a sealed water-tight connection with the hole 508*a* of the bottom plate 508. The O-ring in groove 516*a* helps keep a water-tight seal between the lock nut 516 and the hole 508*a* in the bottom plate 508, and the O-ring in groove 504 keeps a water-tight seal between the outer perimeter of the bottom plate 508 containing the O-ring in groove 504 and the side of the main valve plate 502 facing the bottom plate 508, as illustrated in FIG. 4B.

The pressure sensor 512 is disposed in the bottom plate chamber 510 and threaded into the sensor port 508*b*, and the temperature sensor 514 is disposed in the bottom plate chamber 510 and threaded into the sensor port 508*c*. Here, the pressure sensor 512 can detect the pressure of water in the shoe 450 flowing from the water main and the temperature sensor 514 can detect the temperature of water in the shoe 450 flowing from the water main, both while making direct contact with the water for an accurate detection.

Still referring to FIG. 4B, the compression fitting assembly 420 is shown to be threaded into the threaded hole 404*b* of the drain valve 404. The compression fitting assembly 420 can receive the tube 418 at one end therein with the plurality of wires 418*a* extending through the tube 418. The tube 418 terminates inside the compressing fitting assembly 420 while the wires 418*a* continue to extend past the compression fitting assembly 420 to each of the sensors threaded to the bottom plate port holes 508*b* and 508*c*. Since the tube 418 extends from above ground down to the compression fitting assembly 420, the bottom plate chamber 510 can remain at atmospheric pressure. Therefore, any leaks between the sensors 512 and 514 and their respective port holes 508*b* and 508*c*, or any leaks past the O-ring in groove 516*a* disposed between the lock nut 516 and the bottom plate 508, or any leaks past the O-ring in groove 504 disposed between the bottom plate 508 and the main valve plate 502 can be discovered easily by observing water flowing up through the tube 418 from the hole 502*b* through the main valve plate 502.

By providing a water-tight seal from the bottom plate chamber 510 up through the tube 418, the sensors 512 and 514 can safely provide electronic signals through the wires 418*a* to any wireless communications electronics equipment disposed above ground. For example, while one end of the wires 418*a* are connected to the sensors 512 and 514 disposed in respective sensor port holes 508*b* and 508*c*, the opposite end of the wires 418*a* can be connected to wireless communications electronic equipment located within or connected to an upper barrel or bonnet of the fire hydrant, which is at atmospheric pressure. The wireless communications electronics equipment, or other electronics equipment, can then transmit the information received from the sensors 512 and 514 to a remote device, such as a computer, etc., which can monitor the characteristics of the water in contact with the sensors 512 and 514.

It is to be understood that the embodiments of the present inventive concept herein described are merely illustrative of the application of the principles of the present inventive concept. References herein to details of the illustrated embodiments are not intended to limit the scope of the claims, which themselves recite those features regarded as essential to the present inventive concept.

What is claimed is:

1. A main valve assembly usable with a fire hydrant, the main valve assembly comprising:

a circular main valve plate having an outer edge circumferentially around one side thereof and including:

a first hole extending through a center thereof; and a second hole extending therethrough between the outer edge thereof and the first hole;

a circular drain valve including:

a first hole extending through a center thereof;

a second hole extending therethrough between an outer periphery thereof and the first hole; and a circular bottom plate disposed at a side of the main valve plate opposite to a side facing the drain valve, the bottom plate including:

a chamber formed into one side thereof facing the main valve plate;

a first hole extending through a center thereof and the chamber, and at least one port hole extending through the bottom plate within the chamber to receive a respective water characteristics sensor therein; and a lock nut having a hole extending partially therein at a center thereof and a groove formed circumferentially around the hole to receive an O-ring that forms a water-tight seal with a side of the circular bottom plate opposite the side facing the main valve plate.

2. The main valve assembly according to claim 1, further comprising:

a compression fitting threaded into the second hole of the main valve and having a tube extending from an inner portion thereof away from the main valve plate, the tube including wires extending therethrough and through the second hole in the main valve plate and into the chamber of the bottom plate.

3. The main valve assembly according to claim 2, wherein the first hole of the drain valve includes at least one groove formed therein to receive a respective O-ring which forms a water-tight seal with a stem of a fire hydrant.

4. The main valve assembly according to claim 3, wherein the first hole of the main valve plate and the first hole of the bottom plate are formed to receive the stem of a fire hydrant therethrough such that the lock nut threads over a threaded end of the stem to seal the drain valve to the main valve with an O-ring in the groove of the drain valve, and to seal the main valve to the bottom plate with an O-ring in the groove of the bottom plate, and to seal the lock nut to the bottom plate with an O-ring in the groove of the lock nut.

5. The main valve assembly according to claim 4, wherein the drain valve is disposed within a valve seat of a fire hydrant such that when the stem is being raised with the fire hydrant the main valve plate also rises such that the beveled outer edge of main valve plate contacts the seat formed about one circular end of the valve seat to form a water-tight seal with seat.

6. The main valve assembly according to claim 5, wherein the drain valve and main valve plate are formed of a metal surrounded by a rubber coating, the rubber coating being flexible to cause a water-tight seal with the stem, the sealing ring and the compression fitting.

7. The main valve assembly according to claim 1, further comprising a pressure sensor threaded into one port hole and a temperature sensor threaded into another port hole.

8. The main valve assembly according to claim 1, wherein the at least one port hole includes threads formed therein and the respective water characteristics sensor includes formed about an outer surface which thread into the threads of the respective port hole to form a water-tight seal therebetween.

9. The main valve assembly according to claim 1, wherein the drain valve further comprises:

a groove formed circumferentially in one side thereof facing the main valve plate, the groove having a same center axis as the periphery and extending between the periphery and the second hole such that an O-ring disposed within the groove forms a waterproof seal with the main valve plate.

10. A main valve assembly of a fire hydrant, the main valve assembly comprising:

a main valve including a drain valve and a main valve plate having a water-tight seal therebetween, the drain valve and main valve plate each including a first hole extending through a center thereof within the circumference of the groove and in axial alignment with each other to each receive a stem of a fire hydrant therethrough and a second hole extending therethrough between the groove and the respective first holes, the second hole of the drain valve being threaded to receive a compression fitting therein; and a bottom plate adjacent to a side of the main valve plate opposite to the side that forms a seal with the drain valve, the bottom plate including:

a trench formed into the side facing the main valve plate;

a groove formed around the trench to receive an O-ring therein that forms a water-tight chamber between the trench and the main valve plate;

a hole extending through a center thereof to receive the stem therethrough, and at least one water characteristics sensor extending through a bottom surface of the trench and out of a side of the bottom plate opposite the side facing the main valve plate.

11. The main valve assembly according to claim 10, further comprising:

a lock nut having threads formed therein to engage with threads formed at the end of the stem and a groove formed circumferentially around the threads to receive an O-ring therein to form a water-tight seal with the bottom plate at a side opposite the side adjacent to the main valve plate.

12. The main valve assembly according to claim 11, wherein the circular groove formed in one of the drain valve and the main valve plate is formed in the drain valve.

13. The main valve assembly according to claim 12, wherein the drain valve and main valve plate are formed of a metal coated with a rubber.

14. The main valve assembly according to claim 12, wherein the first hole in the drain valve includes at least one groove formed therein to receive a respective O-ring that forms a water-tight seal between the drain valve and the stem.

15. The main valve assembly according to claim 12, further comprising:

a brass compressing fitting including a tube extending from one side thereof to receive wires through the compression fitting and the tube, the compression fitting being threaded into the second hole of the drain valve such that the tube provides atmospheric pressure to the water-tight chamber.

16. The main valve assembly according to claim 10, wherein the first hole in the drain valve includes at least one groove formed therein, each groove including an O-ring therein to form a tight seal between the first hole and the stem that extends therethrough.

17. The main valve assembly according to claim 10, wherein one of the drain valve and the main valve plate include a circular groove formed in a side thereof facing the other one of the drain valve and the main valve plate, the groove retaining an O-ring therein to form the water-tight seal therebetween.

18. A method of mounting sensors in a water-proof area below a main valve of a fire hydrant, the method comprising:

providing a first circumferential sealing means along an area adjacent to outer perimeters of a drain valve and a main valve plate of a main valve, the drain valve and the main valve plate each including a center hole formed therethrough and in axial alignment to receive a hydrant stem therethrough;

forming a threaded hole through the drain valve within the circumference of the first sealing means;

threading a compression fitting through the threaded hole in the drain valve, the compression fitting having a tube extending out of one end facing away from the main valve plate to provide outside pressure to an area within the circumferential sealing means between the drain valve and the main valve plate;

forming a second hole through the main valve plate within the circumference of the first sealing means;

providing a second circumferential sealing means along an area adjacent to outer perimeters of a bottom plate and a side of the main valve plate not facing the drain valve, the bottom plate including a trench formed therein within the circumference of the second sealing means, a center hole in axial alignment with the center holes of the drain valve and the main valve plate and extending through the trench to receive the hydrant stem therethrough, and at least one port hole extending through the surface of the trench to receive a respective sensor therein;

threading a water characteristics sensor into the at least one port hole such that the sensor end extends outside the bottom plate, the sensor including wires extending from ends opposite the sensor end;

feeding the wires extending from the at least one sensor through the second hole in the main valve plate and through the tube extending from the compression fitting;

extending the fire hydrant stem through the center holes of the drain valve, main valve plate and the bottom plate;

threading a lock nut onto the end of the stem extending through the bottom plate; and forming a third circumferential seal between the surface of the bottom plate and the lock nut to surround the stem.

19. The method according to claim 18, further comprising:

forming at least one groove circumferentially within the center hole of the drain valve; and inserting a O-ring within the at least one groove to form a tight seal between the center hole of the drain valve and the stem.

20. The method according to claim 18, further comprising:

fitting the main valve into a valve seat threaded into a fire hydrant shoe connected to a fire hydrant with the stem extending therethrough such that when the stem is moved upward and downward, a perimeter of the main valve plate forms a water-tight seal with an end of the valve seat extending into the shoe.

* * * * *